US007425690B2

(12) United States Patent
Schilling

(10) Patent No.: US 7,425,690 B2
(45) Date of Patent: Sep. 16, 2008

(54) HOB WITH ILLUMINATION AND METHOD FOR ILLUMINATING A HOB

(75) Inventor: Wilfried Schilling, Kraichtal (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 11/774,443

(22) Filed: Jul. 6, 2007

(65) Prior Publication Data

US 2007/0262072 A1 Nov. 15, 2007

Related U.S. Application Data

(63) Continuation of application No. PCT/EP2005/013720, filed on Dec. 20, 2005.

(30) Foreign Application Priority Data

Jan. 7, 2005 (DE) ..... 10 2005 001 857

(51) Int. Cl.
*H05B 3/68* (2006.01)
*H05B 1/02* (2006.01)

(52) U.S. Cl. ..... 219/451.1; 219/518

(58) Field of Classification Search ... 219/443.1–468.2, 219/483, 490, 509, 518
See application file for complete search history.

(56) References Cited

U.S. PATENT DOCUMENTS 6,614,006 B2 * 9/2003 Pastore et al. ..... 219/447.1
6,924,465 B2 8/2005 Schilling et al.
6,930,287 B2 8/2005 Gerola et al.
7,076,324 B2 * 7/2006 Harkcom et al. ..... 700/211
2002/0053563 A1 5/2002 Pastore et al.
2004/0238524 A1 12/2004 Lerner

FOREIGN PATENT DOCUMENTS

DE 44 05 610 A1 8/1995
DE 29 712 137 U1 9/1997
WO WO 97/37515 10/1997

OTHER PUBLICATIONS

International Search Report for PCT/EP2005/013720, dated Mar. 10, 2006.
German Search Report for German Application No. 10 2005 001 857.2.

* cited by examiner

*Primary Examiner*—Sang Y Paik
(74) *Attorney, Agent, or Firm*—Alston & Bird, LLP

(57) ABSTRACT

A cooking hob has a cooking hob plate made of glass-ceramic and in which several individual heating units are provided that have a regular hexagonal shape and adjoin each other. Elongate illumination segments are disposed on the outer contours of said heating units. When the cooking hob is operated with several adjacent heating units as a connected heating area, the entire outer contour of said heating area is illuminated, thus indicating to the user which heating units are activated together.

18 Claims, 2 Drawing Sheets

HOB WITH ILLUMINATION AND METHOD FOR ILLUMINATING A HOB

CROSS REFERENCE TO RELATED APPLICATIONS

This application is a continuation of PCT/EP2005/013720, filed Dec. 20, 2005, which is based on German Application No. 10 2005 001 857.2, filed Jan. 7, 2005, of which the contents of both are hereby incorporated by reference.

FIELD OF APPLICATION AND PRIOR ART

The invention relates to a hob with a hob plate and several heating units placed below the same, as well as to a method for illuminating such a hob.

Conventional hobs, for example of glass ceramic material, have precisely defined hotplates, beneath which are provided corresponding heaters in the form of radiant heaters or induction heaters. So-called multicircuit heaters are for example provided with size-differing activatable radiant heaters, which can be adapted for different cooking vessel diameters to the heated surface area. However, even for such multicircuit heaters, the location and surface area or the maximum heatable surface must be precisely fixed.

It is known from U.S. Pat. No. 6,614,006 B2 to split up, so-to-speak, such predefined hotplates so that numerous individual heating units are located under a glass ceramic plate on which can be placed a cooking vessel, whose position and size can be detected. However, as a function thereof, precisely those heating units are activated which are completely covered or at least covered in a predefined adequate amount by the cooking vessel. However, in certain circumstances an operator suffers from a feeling of uncertainty regarding the actual operation of individual heating units, because the operator does not precisely know which of these heating units are activated or at which points heating is taking place.

BRIEF DESCRIPTION OF THE DRAWINGS

Embodiments of the invention are diagrammatically represented in the drawings and are further explained hereinafter. The drawings are described below.

DETAILED DESCRIPTION

Figure 1:
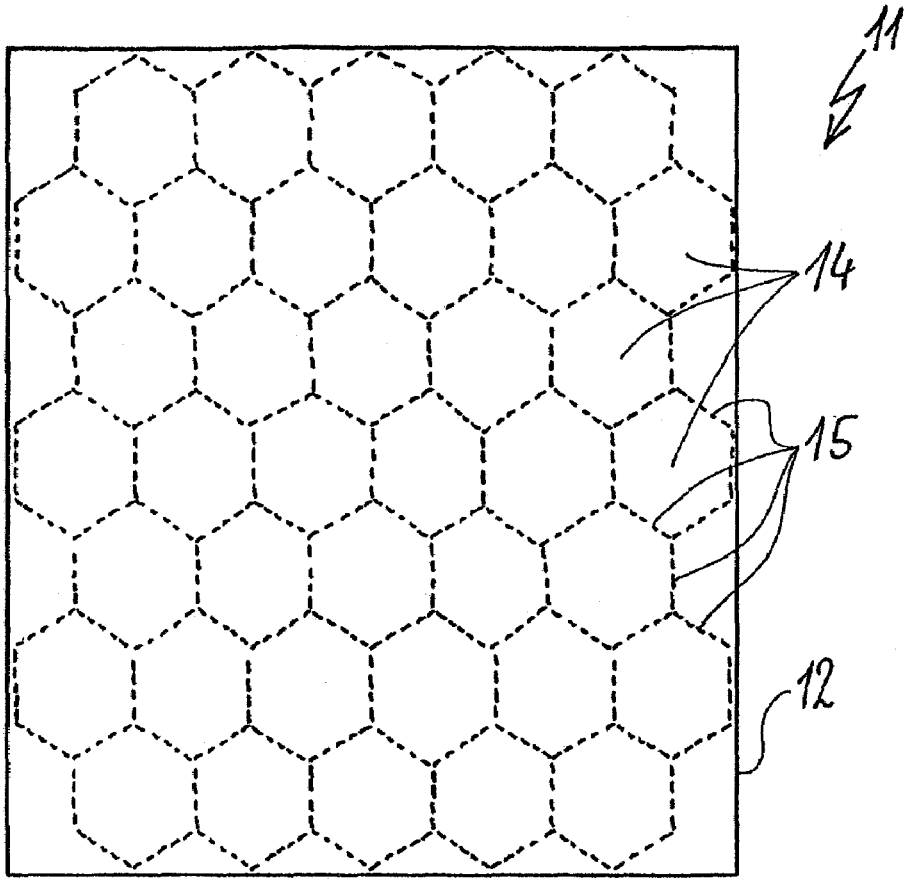
FIG. 1 illustrates an arrangement of a plurality of hexagonal heating units under a hob plate of a hob.

The problem of the invention is to create an aforementioned hob and method with which it is possible to avoid the prior art problems and in particular in the case of hobs with several, individually combined activatable heating units forming freely determinable hotplates, to indicate their operation with complete certainty.

This problem is solved in one embodiment by a hob having the features of claim 1 and a method having the features of claim 8. Advantageous and preferred developments of the invention form the subject matter of further claims and are explained in greater detail hereinafter. By express reference the wording of the claims are made into part of the content of the description. Hereinafter features which apply independently both for the hob and for the method are, in part, only described once, but independently of this they apply to both the hob and the method.

The heating units are advantageously connected relatively directly without large gaps and are individually controllable and can be individually supplied with power. They are operated jointly in specific patterns or specific surface areas in such a way that they form a heating surface whose position and size can be determined. This corresponds to a hitherto known hotplate of a hob on which precisely one cooking vessel is placed for heating purposes. The hob has an illumination or lighting associated with the heating units. Along the sides or outer contours of the heating units are provided several illuminations which are essentially directed connected to one another or run along the outer contours of the heating units. In this way it is possible to mark the outer contour of a heating unit, or which contour can also be displayed through a hob plate, particularly a glass ceramic plate. These illuminations are variously controllable. They can be so controlled by a control means according to the inventive method that exclusively power-supplied heating units are illuminated or indicated by the illumination. As an extension to the invention this is also understood to mean that a hob can recognize over which heating units a cooking vessel is placed. Prior to power being supplied, said heating units can be marked by illumination in a corresponding manner, so that prior to power activation an operator knows which heating units or which surface resulting therefrom is affected and heated as the heating surface thereof. Thus, the invention makes it possible either directly following power being supplied, or even prior to this, to indicate to an operator by setting down a corresponding cooking vessel which heating units and therefore which resulting heating surface is being heated. Thus, even prior to power being supplied, it is possible to indicate in the case of radiant heaters, which surface then subsequently works as the heating surface. The invention is even more advantageous when using heating units with induction heating, because they are invisible (e.g., do not radiant any light) during operation. Thus, during operation an operator does not have the feeling of not being able to precisely detect whether in fact the correct heating units covered by the cooking vessel are activated. Further, the operator does not misperceive other heating units are activated or deactivated, or otherwise correspond unexpected operation.

Thus, during operation it is possible to detect which heating units are supplied with power. Due to the fact that the illumination runs along the outer contours, there is no need to illuminate the entire surface of the heating unit, which simplifies the illumination.

It is possible to subdivide into segments the illuminations of a heating unit. A subdivision advantageously takes place where a heating unit abuts or bounds one or two adjacent heating units. It is also possible for subdivision to take place at corners or angles of heating units which are in the form of polygons. Here, in particular illuminations are subdivided in each corner or abutment takes place there of two separately activatable illumination segments.

It is possible for an illumination along the outer contours of a heating unit to be elongated, or otherwise linear shaped. Similarly an illumination can have individual light spots, which are arranged along a line and consequently, also optically produce the impression of an illuminated or luminous line, which runs along the outer contour or along one side of a heating unit.

For the illumination it is either possible to use individual, punctiform lighting elements, for example temperature-resistant filament lamps or advantageously LEDs in spot form. Alternatively it is possible to use LEDs in conjunction with light guides, as well as light distributing devices or elongated or bar-like lighting means or LEDs.

In an advantageous development of the invention the heating devices have a polygonal or also regular polygonal shape, which is in particular such that on combining several of these heating units they substantially completely cover a surface. An illumination segment runs along each edge or side of such a heating unit. Each illumination segment is controllable independently of the others.

It is not necessary to activate all the illuminations of all the power-supplied heating units, but instead only those which run along the outer contour of the complete, continuous heating surface. Thus, there is only a precise marking of the heated overall surface, i.e. the heating surface per se. Moreover, in most cases the intermediate illumination segments are covered by a cooking vessel placed thereon and would in any case not be noticed.

It is considered adequate to provide only one illumination segment in the vicinity of the broader of two heating units and this runs along a boundary line. If one of the heating units of said boundary line is activated, the illumination segment is also activated. Thus, for this purpose there is no need to provide two parallel illumination segments in such a way that each heating unit has its own illumination segments. Essentially, illumination segments are provided along the boundaries or outer contours of heating units.

The illumination of the outer contours of individual heating units or a completely formed heating surface gives further possibilities for different operating modes or for the display of specific information for an operator, which advantageously can be intuitively determined. It is possible to vary the brightness of the illuminations. Thus, for example, after setting down a cooking vessel in a lower power level the resulting overall heating surface can be indicated. If this heating surface is supplied with power over the individual heating units, the brightness can be increased to a higher level in order to indicate operation. It is also possible to vary the brightness corresponding to a set power or cooking level.

Alternatively, or in additional to varying the brightness of the illuminations, they can also be operated in flashing or varying manner. Thus, for example in place of a lower brightness level, as described hereinbefore, a flashing can indicate the selection of the heating units and a continuous illumination can indicate the actual operation of said heating units. It is also possible to have a rotary light signal, i.e., in such a way that in alternation or rotation can appear on an activated heating surface; in each case one illumination segment after the other is briefly activated and rotates.

If during the operation of the hob or a cooking process a cooking vessel is raised or shifted, this is detected by the hob. The above-described illumination is then correspondingly adapted from the heating surface, so that the illumination in fact always precisely indicates the heating surface supplied with power.

If several cooking vessels are placed on an inventive hob and therefore several heating surfaces are operated, precisely the same applies in each case to their operation or the operation of both heating surfaces does not bring about mutual interference. Even in the case where the heating surfaces are directly adjacent to one another, it is still possible to differentiate the outer contours of individual heating units, because advantageously for the necessary coverage a heating unit must at least half be covered by the cooking vessel to be selected for the heating thereof.

These and further features can be gathered from the claims, description and drawings and the individual features, both singly and in the form of subcombinations, can be implemented in various embodiments of the invention and in other fields and can represent advantageous, independently protectable constructions for which protection is claimed here. The subdivision of the application into individual sections and the subheadings in no way restrict the general validity of the statements made thereunder.

FIG. 1 shows a hob 11 having a hob plate 12, which is light-transmitting and is advantageously made from glass ceramic or tempered glass. Numerous heating units 14 are placed under the hob plate 12 and have a hexagonal construction and in particular are substantially regular hexagonal, i.e. with edges 15 of equal length and are so positioned that in much the same way as a honeycomb surface they are connected directly to one another. In substantially uninterrupted manner they cover the surface of hob 11 or hob plate 12.

Figure 2:
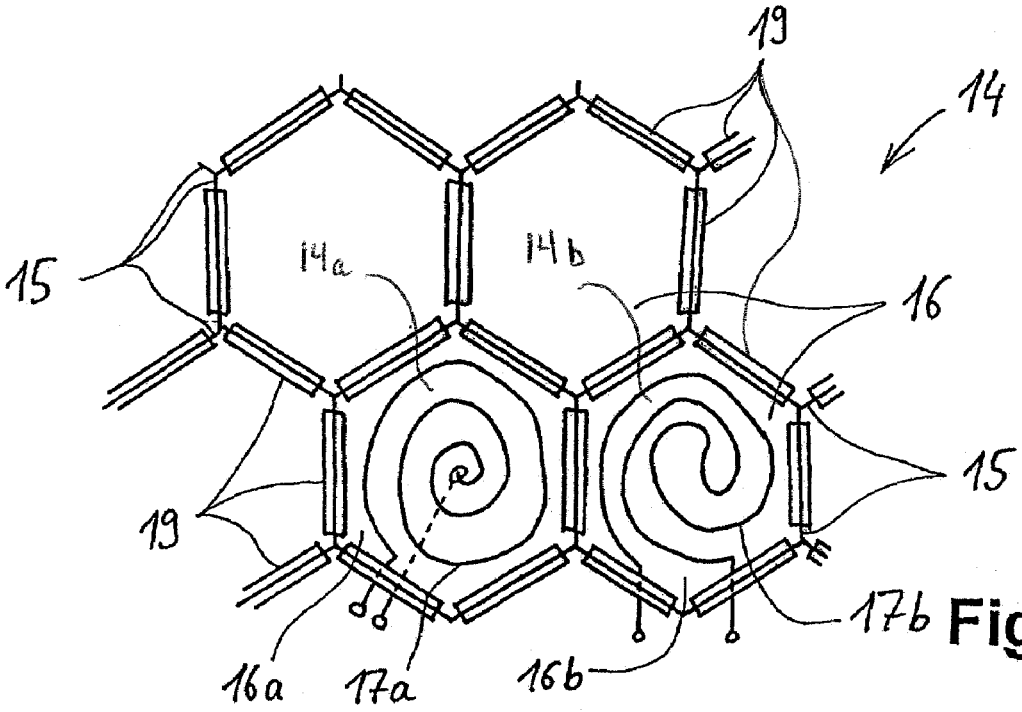
FIG. 2 illustrates two possible constructions of a hexagonal heating unit as an induction heater and radiant heater with illumination segments along the outer contours or on boundary surfaces to adjacent heating units.

FIG. 2 shows two different possibilities of constructing such heating units 14 on a larger scale. One heating unit 14*a* has a support 16*a*, which is, for example of insulating material such as ceramic. To it is fixed an induction coil 17*a*, which represents the heating of said heating unit 14*a*.

A further heating unit 14*b* is shown, which also has a support 16*b* and illumination segments 19. However, this heating unit 14*b* has a heating conductor strip 17*b* and is constructed as a radiant heater in the manner known to the expert. With respect to the construction of such heating units reference is made to DE 103 14 690 A1 and U.S. Pat. No. 6,614,006 B2, whose contents, by express reference, are made into part of the content of the present description.

Along the outer edge of heating units 14 are provided illumination segments 19, which in each case are virtually as long as one side of a heating unit 14. In the case of the union of several directly juxtaposed heating units, it is clear that in each case along the boundary lines or between two heating units 14 there is an illumination segment 19. On the downwardly directed side bounding one edge of the hob 11, admittedly no connecting heating units are provided on the lower heating units 14, but also here the illumination segments 19 are located along the sides or edges 15.

Figure 3:
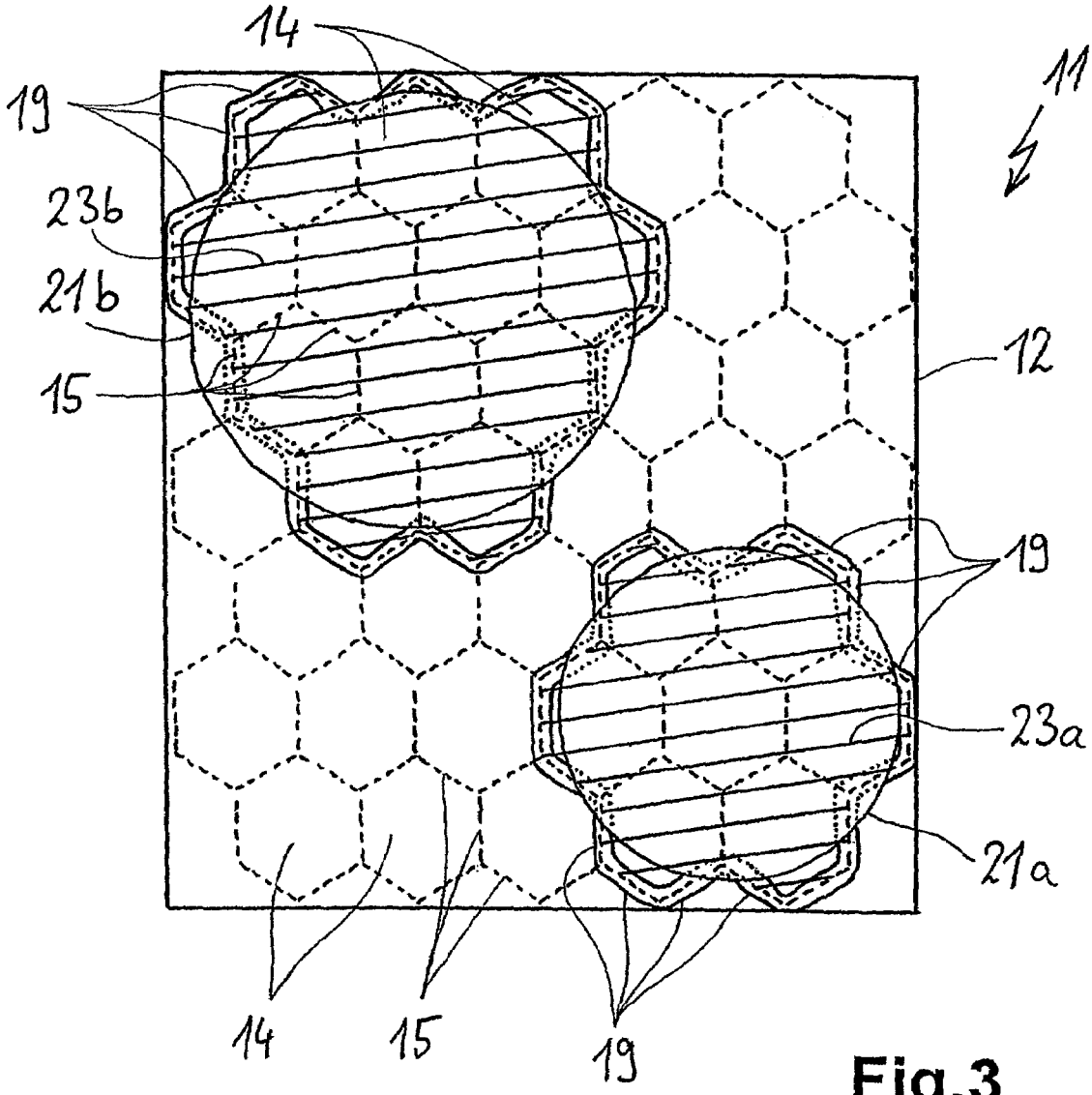
FIG. 3 illustrates the hob of FIG. 1 with two cooking vessels placed on it and activated illumination segments resulting therefrom.

FIG. 3 shows the hob 11 of FIG. 1 with two cooking vessels 21*a*, 21*b* placed on it and which in plan view are merely represented as a circle. In each case they cover some heating units 14 of hob 11 to the extent that by means of a cooking vessel detector (not shown), which is advantageously integrated into each heating unit 14, they are shown as selected for heating operation. The illumination segments 19 of the selected heating units 14 are activated a control means of hob 11 (not shown). They form a luminous or shining border of the selected heating units 14 or the resulting determined or formed heating surfaces 23*a*, 23*b*, which are illustrated by light hatching lines. By means of said shining border through the illuminations 19 it is possible for an operator to detect which heating units 14 are intended for operation and possibly are already being operated or supplied with power.

It is also possible to detect that illumination segments 19 within the heating surfaces 23*a*, 23*b* or on mutually adjacent and activated heating units 14 are not activated. This has been described hereinbefore and serves to mark the total heating surface produced and not the individual heating units 14 forming the same. Thus, an operator does not see how the heating surfaces 23*a*, 23*b* are formed from individual heating units 14 and instead only perceives the same as a whole in the same way as a conventional hob hotplate.

In connection with the control of the individual heating units 14, reference is made to DE 103 14 690 A1 and U.S. Pat.

No. 6,614,006 B2 mentioned hereinbefore concerning the construction of such individual heating units. The control of the individual illumination segments 19 can take place in a particularly simple variant in that they are always operated together with the surrounding heating unit 14, and are for example coupled to the same power supply. However, then it is not possible to only illuminate the outer contours of a heating surface 23 produced.

For this purpose it is possible either to provide a separate lead for each illumination segment 19, or provide the same with its own control and a control system in the form of a bus system controlled by a hob control means.

Further possibilities resulting from the fundamental principle of the invention, such as the previously described flashing of individual illumination segments 19 or a rotary light signal or the like are not expressly described herein. However, they are readily apparent and can be easily implemented by the expert on the basis of the preceding description and the drawings.

The invention claimed is:

1. A hob with a hob plate and with a plurality of heating units placed in an adjacent manner under said hob plate wherein an adjacent subset said plurality of heating units are configurable to form a size-determinable surface heating area corresponding generally to a shape of a cooking vessel placed to one of several locations on the hotplate, wherein said hob has a plurality of illumination sources associated with said plurality of heating units, wherein along an outer contour of said adjacent subset of heating units a subset of said plurality of said illumination sources are positioned for indicating the outer contour of said surface heating area when illuminated and which said subset of said plurality of said illumination sources are individually controlled.

2. The hob according to claim 1, wherein said plurality of illumination sources comprise a plurality of illumination segments wherein each illumination segment separates two adjacent heating units.

3. The hob according to claim 1, wherein said plurality of illumination sources are positioned to form a plurality of segments wherein each segment has one end adjoining at least one other end of another segment.

4. The hob according to claim 3, wherein said heating units comprise a polygon shape comprising six corners and the location of said adjoining of one end of said segment with at least one other end of said another segment is positioned at one of the corners of one heating unit.

5. The hob according to claim 1, wherein said plurality of illumination sources are each formed in an elongate shape.

6. The hob of claim 5 wherein each elongate shape comprises a plurality of individual light sources positioned along a line.

7. The hob according to claim 5, wherein said plurality of illumination sources comprises a plurality of elongated LEDs.

8. The hob according to claim 1, wherein a brightness of said a subset of said plurality of said illuminations sources is adjustable.

9. The hob according to claim 1 further comprising a controller configured to detect the presence of a cooking vessel on the hob and identify the adjacent subset said plurality of heating units positioned underneath said cooking vessel thereby configuring the size-determinable surface heating area.

10. The hob according to claim 1 wherein the heating units are induction heating units comprising a hexagon shape.

11. A method for illuminating a hob comprising a plurality of heating units placed in an adjacent manner under said hob plate wherein an adjacent subset said plurality of heating units are configurable to form a size-determinable surface heating area corresponding generally to a shape of a cooking vessel placed to one of several locations on the hotplate, wherein said hob has a plurality of illumination sources associated with said plurality of heating units, wherein along an outer contour of said adjacent subset of heating units a subset of said plurality of said illumination sources are positioned for indicating the outer contour of said surface heating area when illuminated and which said subset of said plurality of said illumination sources are individually controlled, said method comprising the steps of:

providing power to the adjacent subset of the plurality of heating units;

identifying the subset of plurality of said illumination sources corresponding to the outer contour of said adjacent subset of the plurality of heating units; and providing power to said subset of plurality of illumination sources thereby illuminating said outer contour of said surface heating area.

12. The method according to claim 11 wherein the step of providing power to said subset of plurality of illumination sources thereby illuminating said outer contour comprises providing power solely to said subset of plurality of illumination sources.

13. The method according to claim 11, wherein the step of providing power to said subset of plurality of illumination sources thereby illuminating said outer contour comprises providing power at different levels to a further subset of said subset of plurality of illumination sources.

14. The method according to claim 11, wherein the power provided to said subset of illumination sources produces illumination having a varying brightness or a flashing frequency.

15. The method according to claim 11, wherein only said illuminations forming said outer contour of said heating surface area are permanently switched on for generating a light, said light surrounding said outer contour of said hotplate and is formed by said illuminations.

16. A method according to claim 11, wherein the step of providing power to said subset of plurality of illumination sources thereby illuminating said outer contour comprises the steps of:

a. providing power to a first one of said subset of said plurality of illumination sources;

b. waiting a predetermined time;

c. further providing power to a second one of said subset of said plurality of illumination sources wherein said second one is adjacent to said first one; and d. repeating steps b)-c) until the last one of said subset of said plurality of illumination sources is powered thereby resulting in the illumination of said outer contour.

17. The method according to claim 11, further comprising the step of:

detecting the presence of a cooking vessel on said hob, wherein said cooking vessel is positioned over said adjacent subset of plurality of heating units.

18. The method according to claim 17 further comprising the steps of:

detecting a movement of said cooking vessel wherein said cooking vessel is no longer positioned over said adjacent subset of plurality of heating units but is positioned over a second adjacent subset of plurality of heating units;

removing power from those heating units within said adjacent subset of plurality of heating units which are not within said second adjacent subset of plurality of heating units; and providing power to those heating units within said second adjacent subset of plurality of heating units which were not previously within said adjacent subset of plurality of heating units.

* * * * *